United States Patent [19]

Morton

[11] Patent Number: 4,720,246

[45] Date of Patent: Jan. 19, 1988

[54] SIPHON-CONTROLLED PNEUMATIC DISPLACEMENT PUMP

[76] Inventor: Paul H. Morton, 180 Berkeley St., Satellite Beach, Fla. 32937

[21] Appl. No.: 889,874

[22] Filed: Jul. 28, 1986

[51] Int. Cl.[4] ..... F04G 1/06

[52] U.S. Cl. ..... 417/53; 417/139

[58] Field of Search ..... 417/53, 86, 109, 124, 417/131, 137, 139, 140

[56] References Cited

U.S. PATENT DOCUMENTS

| | | | |
|---|---|---|---|
| 1,456,013 | 5/1923 | Smythe | 417/131 |
| 1,514,698 | 11/1924 | Hampton | 417/139 |
| 1,741,069 | 12/1929 | Oliphant | 417/139 |
| 2,450,140 | 9/1948 | Hawley, Jr. | 417/139 |
| 2,849,963 | 9/1958 | Duby | 417/139 X |
| 4,025,237 | 5/1977 | French | 417/138 X |
| 4,083,661 | 4/1978 | McPherson et al. | 417/131 |
| 4,265,599 | 5/1981 | Morton | 417/54 |
| 4,305,700 | 12/1981 | Beard | 417/121 |
| 4,380,419 | 4/1983 | Morton | 417/334 |

*Primary Examiner*—Leonard E. Smith
*Attorney, Agent, or Firm*—Harold Gell

[57] ABSTRACT

This patent presents a method of operating an apparatus and the apparatus which is a pneumatically operated fluid pump including a compressed air driven blow chamber which forces fluid into a collecting and measuring means that is emptied via siphoning techniques to control a blow and flood regulator responsive to the weight of the collected fluid.

24 Claims, 7 Drawing Figures

CHAMBER FLOODING

CHAMBER BLOW

SIPHON-CONTROLLED PNEUMATIC DISPLACEMENT PUMP

THE INVENTION

The invention is directed toward energy transfer processes that are primarily accomplished through the automatic opening and closing of valves.

BACKGROUND OF THE INVENTION

The Siphon-Controlled Pneumatic Displacement Pump herein presented is an extension of the inventor's original theme, and was designed and developed in the hope that it can help to solve a specific world problem.

The population explosion and world-wide climatic changes have created a problem of global magnitude in which a vast number of the world's population has difficulty in obtaining a daily supply of sanitary drinking water. The World Health Organization places the daily human death rate, directly attributable to the drinking of polluted water, in the tens of thousands. A 1984 news release by Xinhau, the official Chinese news agency, reported that, in China alone, over 500 million people were drinking unsanitary surface water from rivers, ponds and shallow wells. The dangers and risks involved in the human consumption of surface water are too well known to need further elaboration. The technical reason for this forced dependence on unsanitary surface drinking water, some 200 years from the start of the Industrial Revolution, does need considerable elaboration. Unfortunately, the technical reason for the problem does not easily adapt to a brief explanation.

The basic weakness of present-day water well pumping technology that prevents its rapid transfer to lesser-developed countries is, in large degree, caused by industry concentration on pumping methods that only adapt in economic environments. common to the industrialized nations. In these relatively rich, industrialized nations, the present well water pumping technology is very efficient and very effective. The motor and engine-driven pumps produced by the industry, utilizing relatively high-speed rotating mechanical liquid displacement members, allow access to huge quantities of deep source sanitary water. These pumps, in combination with an effective surface water filtering and purification technology, account for the relative abundance of sanitary drinking water in most all of the industrialized nations. The efficiency of this combined technology is best illustrated by the fact that, on a daily basis, Americans alone dump more drinking-quality water down the sewer than would be required to sustain the 500 million Chinese people now drinking the potentially very dangerous surface water.

With conservation, the daily drinking and cooking water requirement for a family is quite small. Technical limitations inherent in existing water well pumping technology prevent its being transferred to non-industrialized rural areas of the lesser-developed countries to meet even this small requirement. The present industry concentration on well water pumps driven by engines and motors renders the technology useless if the engines, and motors are not available to drive the pumps. The low per-capita income that prevails in most of the world's non-industrialized areas dictates that the preferred method of water pumping must be either by hand or by some other form of cheap alternative energy.

The cheap alternative energy referred to here would have to be animal power when widely-separated families were involved. Other non-animal alternative energy sources are far too expensive to be applied on an individual family basis when the annual per-capita income is taken into consideration.

The average healthy male in good physical condition can produce a work output of ⅛ to 1/10 horsepower throughout an 8-hour work day. With a new and different water well pumping technology, the utilization of just a small percentage of this daily work output capability would be sufficient to provide the average family with a daily supply of sanitary water from deep water sources to meet their cooking and drinking needs. The "how" and "why" of this new and different water pumping technology can only be appreciated when it is judged alongside the existing technology as it relates to deep well water extraction utilizing fractional horsepower inputs and non-motor or non-engine driven pumps.

The only hand-powered water well pump in common use today is the piston pump which has been around for over 2,000 years and was used for water pumping by inhabitants of the Roman Empire. The piston pump can take the form of a lift pump or a force pump. The difference in the lift pump and the force pump is the piston's location in relationship to the water being pumped.

In the lift pump, the water is always below the piston and the filling of the pump cylinder is accomplished through atmospheric pressure. Because of an atmospheric pressure constraint, lift pumps cannot effectively obtain water that is 25 feet or more below the pump piston. This 25-foot lift constraint becomes even greater with an increase in altitude. In fact, the 25-foot limit will drop to 22 feet at an altitude of 3,000 feet above sea level. Water obtained from wells 25 feet or less in depth is considered to be surface Water. Unfortunately, the vast majority of hand-operated lift pumps have the piston located above ground level and the water extracted with these pumps does not have the benefit of deep earth filtration. These common, above-ground, piston pumps readily adapt to an easily drilled 2-inch well with its relatively inexpensive well pipe. This fact accounts for their popularity in rural areas.

The force pump places the piston down the well in the water to be pumped. The force pump is very effective on deep water applications and is utilized extensively on the wind-driven pumps found on many farms and ranches. Placing the piston inside the well pipe and below ground level adds considerably to the cost of the pump. With 4-inch diameter and larger wells, and with power sources such as Wind turbines and internal combustion engines, the in-the-well piston-type force pump is practical. To, extract deep water from small diameter wells in the lesser-developed countries, the force pump, with its accompanying array of in-well components and its mechanically-connected linkage to a ground level power source, is not practical.

A very high percentage of the world's usable fresh water supply is located at depths that are less than 200 feet from ground level but greater than 25 feet. The drilling of small diameter wells to these depths is not difficult or energy intensive. The drilling can be accomplished with small machines or by utilizing the ancient method of hand pounding. The Chinese people have been pounding holes in the ground for almost 2,000 years with massive hand-lifted metal bits and they can be considered experts in utilizing this technique. Unfortunately, many useless holes were pounded into good water supplies that could not be utilized because the water Would not rise in the hole to the less than 25-foot pumping range required for a lift pump with an above-ground piston.

The recent advent of low-cost plastic pipe allows small diameter wells to be economically provided with an effective casing to seal off possible intrusion of polluted surface water.

Other recent advances in drilling technology have produced small rotary drilling machines which are easily transported and non-energy intensive. These small drilling machines have made the drilling of vast numbers of small diameter deep wells economically practical. The small machines referred to are capable of drilling a 2-inch well to a depth of 200 feet. However, if you drill a 2-inch well and the Water is down more than 25 feet, there is presently no practical way to bring this water to the surface without a motor or engine-driven pump. This limitation excludes the 2-inch well from many rural areas. It also prevents an access to sanitary water for many millions of poor people.

The Siphon-Controlled Pneumatic Displacement Pump herein presented will allow economical access to the vast stores of sanitary water available below the 25-foot level in many of the lesser-developed countries.

A study of the prior art reveals that very few pneumatic displacement pumps with an automatic cycle control have been built. One such pump, as described in U.S. Pat. No. 4,083,661, is utilized to pump sewage. In this application, a tank is placed at a low sewage collection point and, when the tank becomes full, compressed air is applied to blow the tank contents to the main sewer line having a higher elevation. Total control of the pump cycle is accomplished by a float-operated spool-type air valve located within the tank. The size, the manufacturing cost, and the confinement of the total control system within a large tank, renders this pump not practical for well water pumping in small diameter wells.

Another pneumatic displacement pump was presented in U.S. Pat. No. 4,305,700. This pump was designed to pump oil from slow-flowing and marginal oil wells. It utilizes a series of vertical blow chambers that drop into the well pipe and are connected together with pipes. The objective of this invention is to use compressed air to make a vertical stair-step type lift of the oil by means of compressed air being applied in a timed sequential sequence that progressively moves the oil upward through the blow chambers to a ground-level storage tank. Control of the blow and vent process is by means of a timing-motor driven rotary valve. The only positive control in this cycle is a float switch that prevents a restart of the timed cycle if no oil is present in the bottom blow chamber.

The inventor knows of another manufacturer in Australia who utilizes a timing motor to control a water well pumping cycle by means of a similar arrangement. A timed control of the blow cycle is not practical when utilizing alternative energy sources that produce wide variations of energy inputs to the pumping process. The specification that follows incorporates more details than would normally be required in a patent specification. The excessive detail is provided to assist the professional, as well as the lay reader, in full understanding of the invention. In the mind of the inventor, the magnitude of the problem addressed by the invention justifies this extra detail effort.

The dominating objective that resulted in the present invention was a desire by the inventor to provide an economical means to pump usable amounts of water from depths of up to 200 feet from small diameter wells using energy inputs to the pumping system that could be provided by a small child. The inventor sincerely hopes that through this invention some of the aforementioned problems can be mitigated.

OBJECTIVES OF THE INVENTION

It is a primary objective of the present invention to provide a small human-powered water pumping system that will allow economical access to deep sanitary water supplies from small diameter wells.

A further objective of the present invention is to make the aforementioned pumping system operate on compressed air using a positive water displacement type of pumping process.

Another objective of the present invention is to allow the source of energy, needed to power the pumping system, to be shifted from human power to any alternate compressed air supply automatically.

A still further objective of the present invention is to provide the manually-operated air pumps used in the system with features that allow an easy change in mechanical advantage to accommodate human operators with wide variations in strength and stature.

Another objective of the present invention is to provide the pumping system with an automatic pumping cycle control which will operate effectively and reliably when power inputs to the air pump are 1/10 horsepower or less.

A still further objective of the present invention is to provide a pumping system that, through a simple modification in the air pump construction, allows the energies of two or more human air pump operators to be combined to increase pump flow rates or reduce individual work effort.

Another objective of the present invention is to utilize a high percentage of plastics in the system to take full, advantage of its unique properties and low cost.

A further objective of the present invention is to provide the pumping system with construction features that easily adapt to mass production technology, including simplistic disassembly features which will facilitate small container shipment and on-site component assembly.

A still further objective of the present invention is to provide a pump control system design that adapts to very small pumping systems or very large pumping systems through a simple increase in component size.

The foregoing and other objectives of the invention will become apparent in light of the drawings, specification and claims contained herein.

SUMMARY OF THE INVENTION

This invention, in its presented basic form, relates to a method of pumping water from small diameter deep wells using compressed air from any suitable source as a medium to move the water. The water is elevated from a "blow chamber" which is installed within the well pipe and positioned below the standing water table. The pumping process is by direct pneumatic displacement and is identical to the process that occurs within the compressed air operated garden sprayer tank.

During a blow cycle, the force of compressed air impressed on top of the water surface displaces the water upward through a dip tube and discharge check valve to an above-ground receiving chamber, which is designated as the "siphon control chamber". The compressed air causing the liquid displacement is fed to the system from ground level and is directed through a small three-way valve. Compressed air from this valve is routed to an air conduit and directed down the well pipe to a quick-exhaust valve. The incoming compressed air is routed through this quick-exhaust valve and into the top of the submerged blow chamber. Water displaced from the "blow chamber" moves up the dip tube through the discharge check valve and ascending conduit to collect in an above-ground siphon control chamber. The "siphon control chamber", through a unique double siphon arrangement, acts to measure the quantity of water being displaced. When a fixed quantity has been displaced from the in-well "blow chamber". a siphon is started that stops the blow cycle by initiating a mechanical close of the three-way air supply valve. The three-way air supply valve, due to its internal construction, automatically starts a bleed to the atmosphere of the compressed air now trapped in the air supply conduit downstream from the valve. The downhole quick exhaust valve responds immediately to this reversed-air flow in the air supply line and automatically opens a large exhaust port to quickly vent the now-pressurized in-the-well "blow chamber" to the atmosphere via the vente well-pipe.

The venting of the submerged "blow chamber" to atmosphere will automatically cause it to refill with water through a water inlet check valve located at its lower end. A controlled flow of the siphon in progress above ground ensures a complete water refill of the submerged "blow chamber". The timed and adjustable termination of the siphon flow causes a mechanical re-opening of the three-way air supply valve and a second blow cycle is initiated. The displacement pumping process is totally controlled by the above-ground siphon assembly. The pump can function automatically with horsepower inputs to the system of less than 1/10 horsepower.

DETAILED DESCRIPTION OF THE INVENTION

Figure 1:
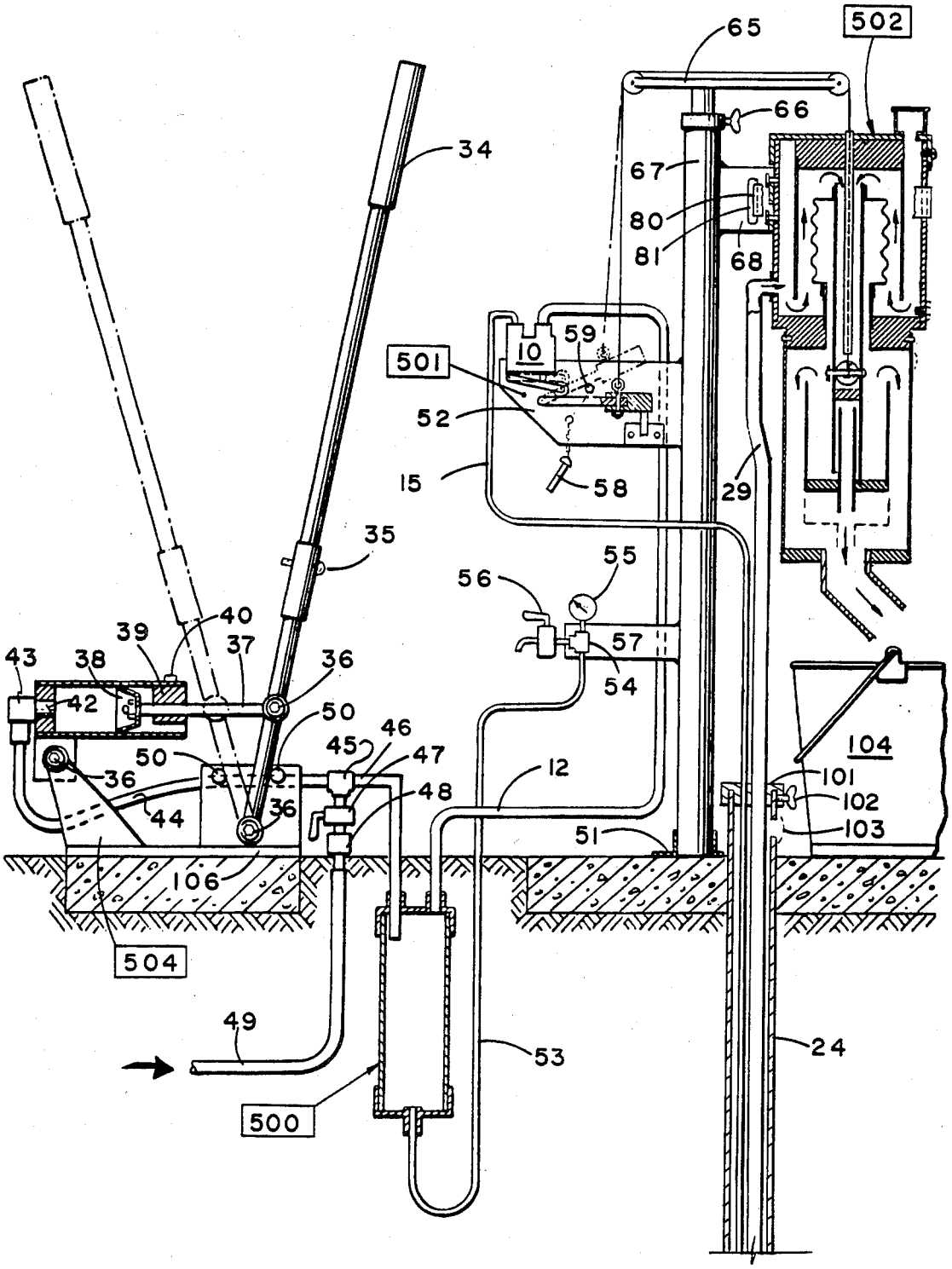
FIG. 1 is a side view of a preferred embodiment of the subject invention containing selective cutaway views of above-ground components of the system, allowing realistic perspective on component size and illustrating functional components.

The present invention represents a continuation of the hydropneumatic pump systems developed by the inventor, Faul H. Morton, and reflected by U.S. Pat. No. 4,265,599 on "Hydropneumatic Energy System" issued May 5, 1981, and U.S. Pat. No. 4,380,419 on "Energy Collection and Storage System" issued Apr. 19, 1983. The concepts and apparatus presented by those two U.S. Patents are hereby incorporated in this specification.

Over the past few years, the inventor has demonstrated many test pumps using the concepts covered in the original patents. This experience with the various demonstrator pumps has led the inventor to the realization that many people have a great deal of difficulty with the basic physics of a pneumatic displacement pump when it is applied to well-water pumping.

This observation, in combination with the fact that the lay reader would not be able to use his local library to research pneumatic displacement pumps, requires that the inventor "bend the rules" in this specification and, in so doing, a few side trips away from the invention will be taken. These side trips are to amplify on important points in the physical processes involved so that the lay reader can relate these processes to everyday experiences and events he is familiar with but has not given serious attention to.

The first such side trip will be to examine the ballast tanks found on all submarines. These ballast tanks are large, rounded tanks welded to the cigar-shaped pressure hull of the submarine. They are used in the process of making the submarine buoyant or non-buoyant. Holes are cut into the bottom of these tanks which are open to the sea. When a submarine is on the surface, the tanks are full of air under a slight pressure that balances the pressure of the sea water which is trying to enter these open holes.

This equal balance of water and air pressure causes the ballast tanks to stay empty of water. For the submarine to attain a negative buoyancy and submerge, a number of large vent valves located in the top of each tank are opened. The ballast tanks immediately flood with water and the submarine sinks. In order for the submarine to surface again, the water in the tanks must be blown out through the bottom holes with compressed air which is released into the top of the tank.

This compressed air is stored in bottles at pressures of 3,000 pounds per square inch, or more. The reason for this high pressure is related to storage space on the submarine. Storage of compressed air at high pressure allows very large amounts of compressed air energy to be stored in relatively small tanks.

The compression of air to 3,000 pounds or more is an expensive and time-consuming process. A submarine requires an adequate supply of this compressed air to blow the ballast tanks as a matter of life or death to the crew and, needless to say, a good crew does not waste this stored energy. Consequently, a submarine operating at a depth of 400 feet would only blow ballast tanks in an emergency situation.

The reason for this is simple physics, and the same physics applies to the pneumatic displacement pump. The pressure of every square inch of the submarine at a depth of 400 feet is close to 176 pounds. Blowing all the water from the tanks at this depth would require a compressed air bubble in the tank having a pressure of at least 176 pounds just to balance the sea water pressure under the ballast tank holes. Creating a bubble of this size and pressure requires a huge expenditure of the stored compressed energy.

If the submarine power plant is working and the screws are providing forward momentum, the submarine crew can use this forward momentum to propel the submarine closer to the surface to save a considerable amount of compressed air energy.

This is accomplished by blowing a small quantity of water from a bow tank which gives the submarine an 'up' angle so that it will act as a plane moving through the water and rise in the water in the same way that an airplane leaves an airport. If the ballast tanks are blown when the submarine reaches the 100-foot level, the air bubble in the tanks will only have a pressure of 44 pounds and the amount of stored compressed air energy used is greatly reduced.

Another device using the simple physics of the pneumatic displacement pump is the compressed air-operated garden sprayer. The process is identical to the blowing of a submarine ballast tank, except that the holes in the bottom of the ballast tank are replaced with a dip tube inside the tank, which directs the downward displaced liquid upward through a connected hose and spray nozzle. The physics of the submarine ballast tank and the common garden sprayer are combined to construct the positive displacement water-well pump presented.

The inventor's reason for starting the description of the invention with side trips to the ballast tanks of a submarine and making the tie-in to the garden spray tank is that they both involve a pneumatic displacement process. The discussion on the submarine was to place emphasis on the fact that compressed air is being used every day to make energy transfers that would be comparable to the energy transfers that occur in a pneumatic displacement pump when making a deep well water lift. It also provided the opportunity to show that, with a compression process, very large quantities of energy can be stored in a relatively small space, but this energy intensification is done with a costly work effort.

Over the past few years, this inventor has demonstrated some of his various inventions (all of which relate to hydropneumatic energy transport) to numerous audiences, some members of which were professionally engaged in the water pumping field. One such demonstration involves using a hand-held 12-volt air compressor, normally used to inflate a low car tire, to make a water lift from a deep well. With very few exceptions, the majority of the observers conclude from this demonstration that a pump which will elevate water from such deep source with less than 50 watts of power must be very efficient.

This false conclusion results from the fact that there are large segments of industry that concentrate their efforts, and use their expertise, in very limited fields.

The nature of energy transfer or, for that matter, energy itself is so complex that few people have the opportunity to delve into areas that do not fall within the narrow confines of their own specialty. This mysterious nature of energy and its transfer accounts for the fact that every few years another "perpetual motion" invention surfaces to attract public attention. Given the elusive nature of energy transfer, and the number of times that so-called experts have been wrong in this area, it is easy to understand why the subject of "perpetual motion" will not stay dead.

This inventor makes no claim to having discovered a new source of energy or a way to use it more efficiently. To the contrary, all of the inventor's work has been in the opposite direction.

The comments concerning "perpetual motion" and the fact that the inventor can mislead a large audience with a very inefficient energy transfer process (simply because it had not been seen before) requires that a complete disclosure include a short primer on what is know about energy transfer as it relates to the invention.

The steam engine introduced the world to the wonders of power by effectively extracting energy from fossil fuel. The internal combustion engine, With the help of Dr. Rudolph Diesel, allowed the concentrated energy in liquid fossil fuels to be extracted with the unbelievable efficiency of 33%. The 'icing on the cake' came with alternating current and the transformer. The transformer phenomenon, and it is a phenomenon, allowed Dr. Diesel's energy to be intensified in a process that has a conversion efficiency of 98%. The steam turbine, with its efficiency advantage, replaced the steam piston engine and, by extracting the energy concentrated in coal and oil, drove the monster generators that, through the marvel of the transformer, allowed transport of huge amounts of power over small conduits throughout the industrialized world. Electric motors took this transported power and converted it back to mechanical energy with an efficiency of 85%. The last entry into this marvelous world of large-scale energy has been nuclear power. There seems to be some controversy regarding the efficiency of nuclear power plants, and much controversy about their safety.

The point being made by the inventor is that industry, up until a few short years ago, had almost totally ignored alternative energy sources because of their known inability to fill the hungry energy needs of an industrialized society.

In the non-industrialized world, a few hydro-electric plants were installed and a few internal combustion engines filtered in but, for all practical purposes, the industrial "smart money" and energy was concentrated on areas that could afford the marvels of high efficiency energy transport using fossil fuel for a base source.

The mind-set produced by this concentration is the reason that observers of the inventor's demonstrator pump are mystified by its 'apparent' efficiency.

Until the recent "energy crisis", very little "smart money" was spent investigating low-intensity energy and the useful things that can be done with it, even when the energy transfer efficiency is very low. Existing manufacturers, even when forced to re-evaluate the total energy situation, did not want to move into alternative energy. Enough was known concerning the difficult task of concentrating energy efficiently to keep "smart money" out of this area. As a result, huge government subsidies had to be brought in to foster new research.

Many times, these low efficiency energy transfers can be made with low outlays of capital. The inventor sees value in this which, combined with the inherent beauty of using energy transfers that involve only a simple open and close of a valve, resulted in this invention.

In continuance of this disclosure, the reasons for the pump's inefficiencies will be explained in detail, allowing the reader to fully understand why a pneumatic displacement pump for deep water pumping cannot be researched in the local library and why "smart money", having within its pool of employees some very knowledgeable engineers, has ignored the pneumatic displacement pumping process.

The efficiency of a small air compressor delivering air at 100 psi will be about 60%. Air compressors are rated by the cubic foot of air displaced each minute at a specified pressure. To put a layman's handle on just what this means, we can use the catalog of a manufacturer specializing in small air compressors and analyze the data sheet for a listed ⅓ h.p. belt-driven air compressor.

The ⅓ h.p. belt-driven air compressor data sheet shows that it will displace 0.70 of a cubic foot of air per minute at 100 pounds pressure. This means that, if connected to a receiver tank provided with a pressure gauge and a bleed valve to atmosphere adjusted to maintain the air in the tank at 100 psi, the quantity of air delivered to atmosphere through the bleed valve would be 0.70 of a cubic foot per minute. The same compressor discharging air into the tank with the bleed valve adjusted to maintain the tank pressure at 20 psi delivers 1.12 cubic feet of air to atmosphere through the bleed valve with the speed of the compressor maintained at 2,000 rpm. A graph plotting of a factory test performed on a unit taken from the production line showed that when the discharge pressure was lowered from 100 psi to 20 psi, the C.F.M. output of the compressor increased by 62%. The power input to the compressor decreased by 62%. This is why the good submarine sailor does not waste his 3,000 pound compressed air. It is also why the energy intensification that occurs within a transformer at 98% efficiency or better is considered a phenomenon, as distinguished from a noumenon. Have hope, you inventors of perpetual motion!

Another area of compressed air energy transfer that seems to confuse people who are primarily involved with water is the relatively large amounts of compressed air energy that can be transmitted through small conduits. This confusion probably results from trying to equate compressed air flow with liquid flow. A very good example of the difference relates to some testing that was done by a major manufacturer of large air compressors. They were trying to nail down the energy losses in a factory air distribution system through small air leaks in the system. They had connected a large air compressor to a drive system that allowed the compressor power input to be increased while maintaining a compressed air pressure in the receiver tank at 100 pounds with a fixed bleed.

They found that, when the size of the progressively larger hole they were drilling in the receiver tank was enlarged to ¼-inch with a drill bit, the air compressor required a power input increase of 25 horsepower to maintain the 100 pounds of tank pressure. This, incidentally, accounts for the growing preference for plastic tubing as the air conduit of choice.

Given the relatively low efficiency of the air compression process and, taking into consideration the even higher energy loss that occurs when it is expanded to do work, one might justly ask why it is even used at all to transport energy.

The answer is that, for doing some jobs, it is the best energy source available for the amount of power needed.

Pneumatic tools are the power tools of choice in automotive assembly lines, due to their relatively small size and high power. For the same reason, the field of robotics incorporates pneumatic control to a very high degree in industrial robots. The high-speed dentist drill is another example.

These and other applications make for a very large industry in spite of the energy efficiency handicaps. Where water pumping must be done without the advantage of an electrical power grid, the inventor feels that the pneumatic displacement pump can be just as viable as the pneumatic tools used in the automobile production lines.

The inventor has never had a problem explaining the mechanical devices that make his various inventions work but has had great difficulty explaining the sometimes evasive physics involved. This accounts for the unusual nature of this specification.

Figure 2:
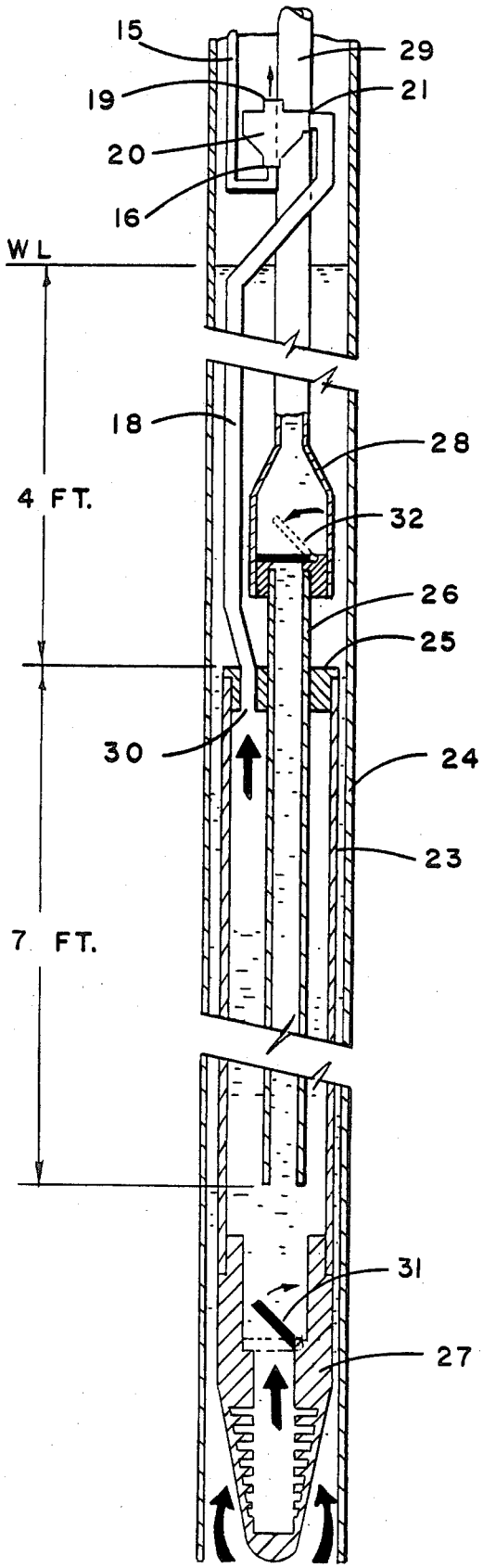
FIG. 2 is a cutaway view of the submerged downhole "blow chamber" illustrating air and liquid flows occurring during the chamber vent or flood cycle.
Figure 3A:
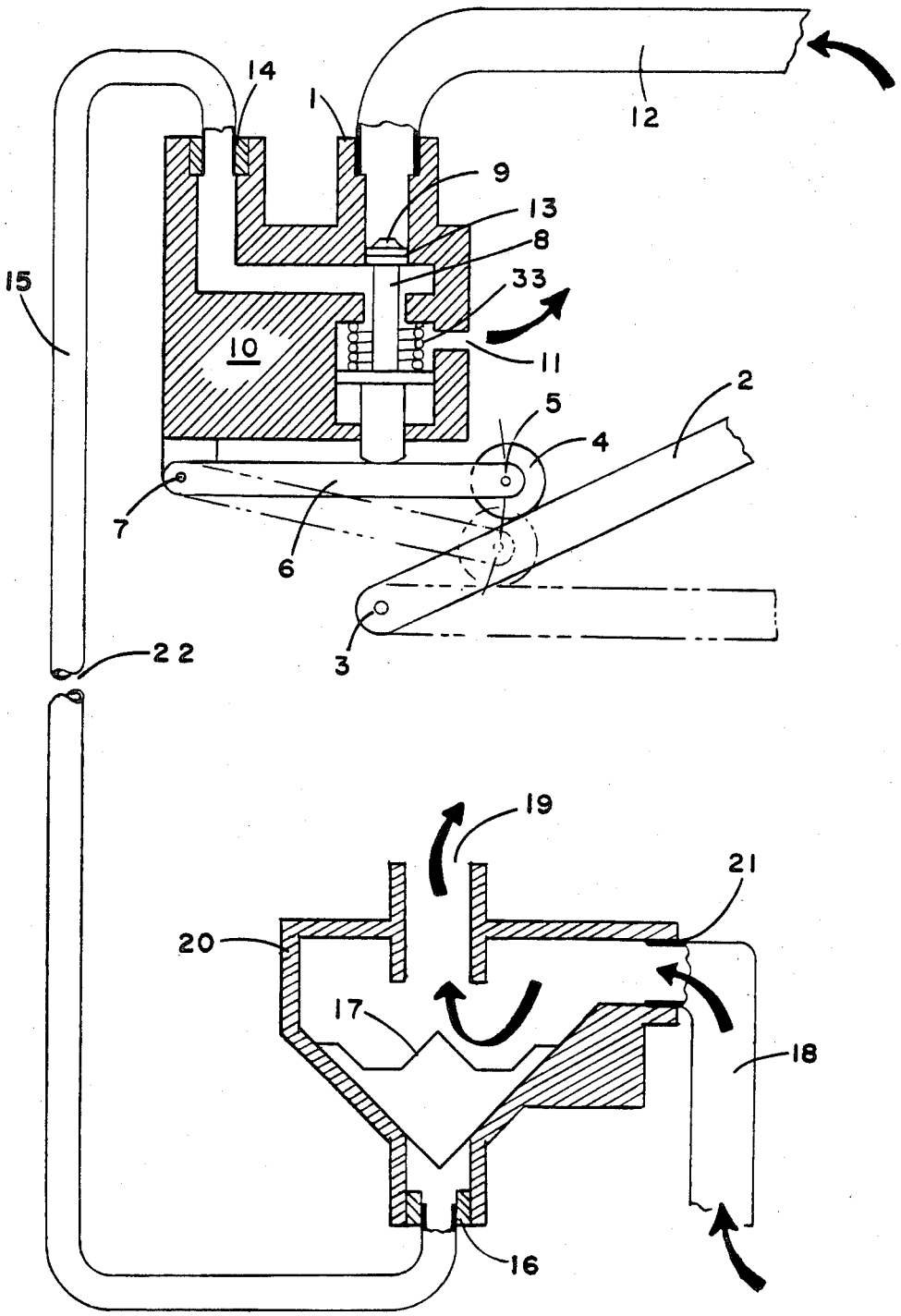
FIG. 3A is a stylistic enlarged cutaway view of the pneumatic valves used to control the chamber blow and vent cycle with air flows indicating a just-initiated vent or flood cycle.

To provide the busy reader with a brief overview of the system, before moving to the more detailed description of the various system components, the reader is referred to FIG. 2 of the drawings. FIG. 2 shows the down-hole submerged "blow chamber" in a vent and refill cycle. Conduit (18) shows air movement out of the chamber as a result of the incoming flood water. FIG. 3A shows a blow-up of quick exhaust valve (20) directing the exhausted air to the interior of the well pipe where it moves up the exhaust pipe and out a vent port at the top.

Figure 3B:
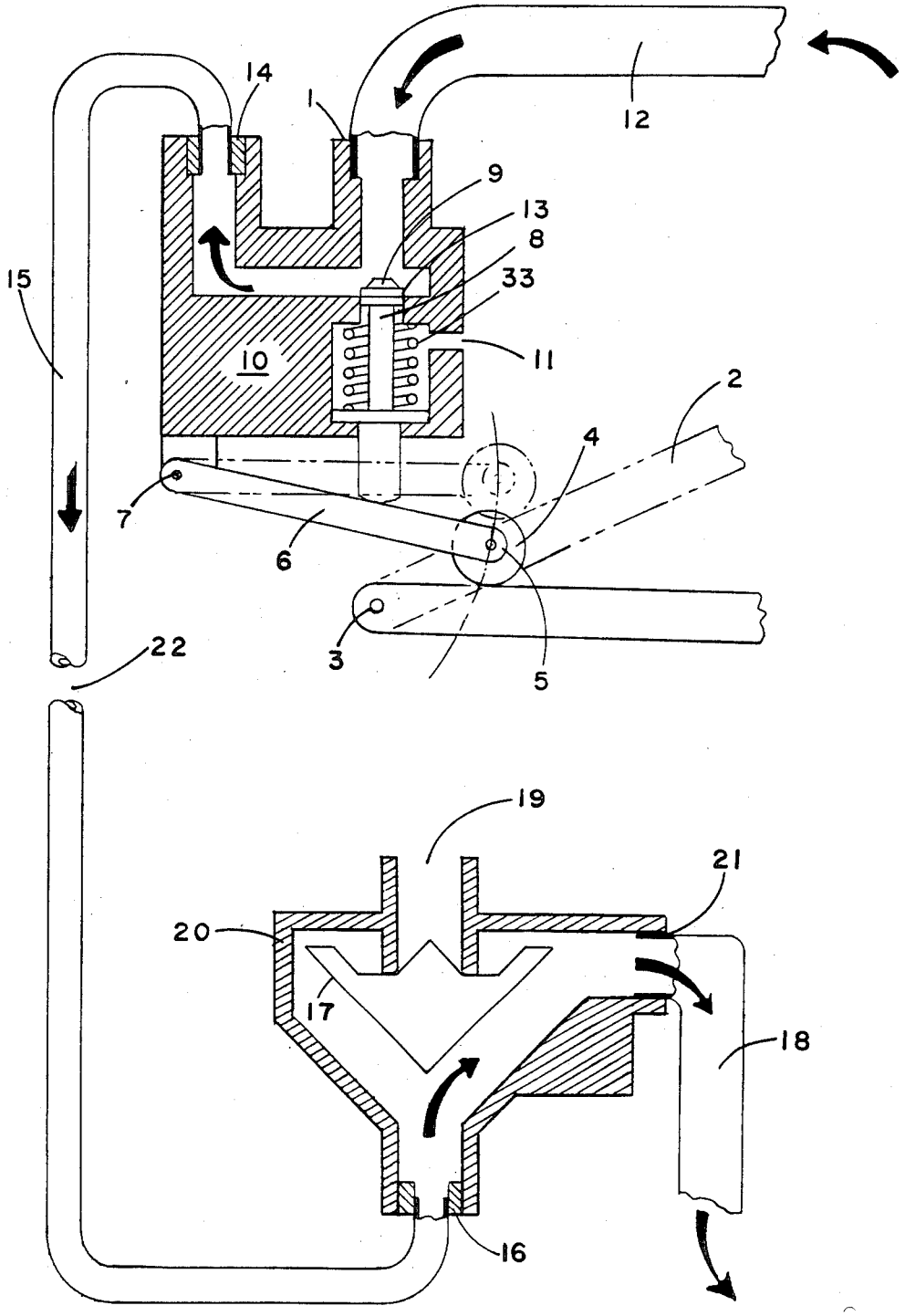
FIG. 3B is a duplication of FIG. 3A indicating air flow through the two pneumatic valves during a chamber blow cycle.

FIG. 3B shows a chamber blow cycle with compressed air being directed through the now-opened "master control valve" (10) through the quick exhaust valve (20) which, by a reverse flow, will automatically shift the position of the free-floating rubber poppet (17) to direct all incoming air to the chamber.

Referring back to Drawing FIG. 2, it can be seen that the air flow arrow will now be reversed. Low check valve (31) will be closed and upper check valve (32) will open to release displaced water forced out by the incoming compressed air. The total control of the flood and vent process is accomplished by the simple opening or closing of master control valve (10), which is located at ground level.

At the ground level location of "master control valve" (10) in FIG. 1, a siphon control chamber assembly, boxed designator (502), acts to measure the incoming water and, through a stop and start of a siphon, mechanically controls the open or close of "master control valve" (10), which is a component part of a bracket-mounted assembly, boxed designator (501).

Size limitations of the "blow chamber" are dictated by the space limitations at the point of submergence. Flow limitations are dictated by power inputs to the system, which could range from 1/40 to over 100 horsepower. As with any other pump, the flow rates from the pump dramatically increase with a reduction of the static head. The previously pointed out high penalty paid for increasing compressed air pressure will result in this pump showing a much larger gain in efficiency with a reduction in static head than would be seen in conventional mechanical displacement pumps.

For this reason, the pneumatic displacement pump's unique features are optimized from the standpoint of efficiency when making low head lifts.

With the preferred embodiment illustrated, the time required to blow a flooded chamber is dictated by the power input to the system and will change accordingly. The time required to re-flood an empty "blow chamber" is dictated by a number of factors, including its degree of submergence. To ensure the complete refill of a blown chamber, the drain time of the above-ground "siphon control chamber" is adjustable.

Assuming that the reader now has a good understanding of the not-so-obvious physics of the pneumatic displacement pump, a more detailed look will be taken at the preferred embodiment.

FIG. 1 shows a three-gallon bucket (104) located at the well-head and acting as a receiving container for the water displaced from the submerged "blow chamber" installed down-hole and confined within well pipe (24). The bucket is ten inches tall and gives the viewer a reasonably accurate reference to place a physical size value on all above-ground components.

The air pump is illustrated to the left of the drawing and, in the preferred embodiment illustrated, is constructed with its major parts of metal. It may be found that a blend of man-made plastics and ceramics could match the durability features of metal at a lower mass production cost.

Important design features involve the ease in which mechanical leverage can be changed on a mass-produced basic pump assembly and the use of easily replaced plastic bushings at all wear points.

Pump handle assembly (34) is a two-piece assembly. The upper part can be removed by a knock-out pin (35). Pump handle length change to accommodate people of short stature is accomplished by a simple cut-off and re-drill of the handle section above pin (35).

The leverage of the air pump is determined by the diameter of the cylinder assembly mounting ell air fitting (43). The cylinder assembly, in addition to mounting ell (43) and check valve (42), mounts a lower tab bracket that, by means of a bolt, retains a plastic spool, the spool acting as a replaceable bearing for the pivot. The three pivot points (36) of the air pump use identical plastic spool bearings.

The pivot construction is identical to the pivot construction used on automotive shock absorbers, with the exception of the plastic spool which resembles the common sewing thread spool, with the flanges of the sewing thread spool being replaced with plastic washers.

Bracket assembly boxed designator (504) is an angled bracket that bolts to bracket (106) with bolts (not shown). This bolt-on feature allows easy removal of the air pump cylinder and bracket as an assembly. With a small assortment of different diameter air cylinders provided with matching attached bracket assemblies, the leverage advantage of a standard air pump configuration can be easily changed to accommodate different pumping situations.

Pins (50) on mounting bracket (106) act as stop points for handle assembly (34) and limit the fixed stroke of piston (38), which is illustrated as a standard leather air pump piston, but could take the form of a conventional ringed piston having a disc check valve in its head. The piston rod is guided in a cylinder-centered position by a drilled plastic guide bushing (3g) retained by screw (40).

Compressed air from the air pump is directed through plastic conduit (44) to tee (45). [In the system presented, all references to plastic conduit will be referring to plastic tubing that connects at the various junction points with suitable connectors not shown in the drawings]. Tee (45) mounts a shut-off valve (47) and an inlet check valve (48) which connects to plastic conduit (49). Flastic conduit (49) allows compressed air to be fed to the system from any alternate air source, if available.

Compressed air moving through tee (45) from the hand-operated air pump or from the alternative source, plastic conduit (49) moves into the air storage tank assembly boxed designator (500). [Tank assembly (500) is buried below ground for safety reasons, as it is constructed of plastic. If moved above ground, it would be protected by a metal cage]. Plastic conduit (53) connects at the bottom of the tank and ascends to tee (54) mounted on pole bracket (57). A pressure gauge (55) mounts at the top of tee (55) and a valve (56) mounts to the left of the tee to drain off condensate that collects in the bottom of the air tank.

Plastic conduit (12) carries compressed air from the top of the air tank to the pole bracket mounted "master control valve" and connected assemblies boxed designator (501). "Master control valve" (10), through a simple open and close process, controls the pumping cycle. This operation will be explained in detail later in the specification.

Note, for now, that the lever arm which controls the close of the valve can be manually lifted to a position illustrated by the dotted lines and retained in this upward position by chain-attached pin (58). Installing the pin (58) in bracket hole (5g) removes the pump from service. The open and close of "master control valve" (10) is accomplished automatically when the pump is in operation by a lever arm operating siphon bucket that connects by fishing line to the lever arm. This string is routed across two grooved pulleys that pivot on tee bar assembly (65). Tee bar assembly (65) includes a cap which is retained in a fixed position at the pole top by winged bolt (66).

Flange (51) at the base of mounting pole (67) is fastened securely by anchors (not shown) to the concrete slab sealing off and retaining the well pipe (24).

Bracket (68) at the top right side of the pole (67) serves to mount the "siphon control chamber" assembly boxed designator (502).

A flat flange on the right side of mounting bracket (68) is notched to accommodate two plastic pins that penetrate the wall pipe of the plastic "siphon control chamber". The pins and notched bracket flange retain the chamber at the proper location on the mounting pole. Metal strap (80) resembles a large hose clamp and, when passed around the "siphon control chamber" and routed through slot (81), makes a solid attachment of the "siphon control chamber" outer pipe to the pole bracket (68).

Plastic conduit (29) transports water from the down-hole "blow chamber" to the "siphon control chamber". Arrows indicate water flow paths that will, at different times, occur within the chamber. Details of this flow will be fully explained later.

Compressed air is transported from the left side of "master control valve" (10) to the down-hole quick exhaust valve. Air flow in conduit (15) is reversed when "master control valve" (10) shifts to the 'OFF' position. This action triggers the shift of the down-hole quick exhaust valve poppet, venting all air from the submerged blow chamber to the interior of the well pipe. Note that, by means of a reducing fitting (not shown), a reduction in air conduit size occurs at "master control valve" (10).

Plastic conduit (15) is directed downward from "master control valve" (10) and enters the well pipe at plug cap (101). Plastic conduit (29), used to transport water to the "siphon control chamber", also enters the well pipe (24) at plug cap (101). A vent hole (103) is drilled in well pipe (24) at an above-ground location and covered by a plastic screen to keep out insects.

Plug cap (101) on its lower side accommodates a matching mechanical compression-type connector for air conduit (15), but the preferred connector for the water conduit (29) is a hose barb and clamp. These connectors are not shown. The reason for the hose barb and clamp connection at this point is because the plastic water conduit (29) serves as a down-hole pull rope for the blow chamber assembly.

Moving now to Drawing FIG. 2, the down-hole "blow chamber" assembly will be examined. In the imagined pumping system illustrated, a good water bearing strata was found, at approximately 89 feet from ground level. The bore hole was drilled to a depth of 110 feet to ensure a good penetration of the strata. A 100-foot length of 2-inch plastic pipe (24) is installed to serve as the well casing.

To obtain a reasonable amount of water with each blow cycle from a "blow chamber" sized to fit a 2-inch i.d. well pipe, a 1½-inch "blow chamber" slightly over seven feet in length was selected. This 7-foot length of 1⅜-inch i.d. plastic pipe (23) will hold slightly over ½-gallon of water when full. To ensure a quick refill of a blown chamber, the top plug cap of the chamber (25) is positioned four feet below the 89-foot water line. The lowest part of the "blow chamber" inlet check valve and strainer assembly (27) is flush with the bottom edge of the 100-foot well pipe (24). The total water lift that must be made from the bottom of the "blow chamber" dip tube (26) is approximately 103 feet. The net water lift is 92 feet. The minimum pressure that the above ground air pump must deliver to overcome the 103-foot static water head is very close to 45 pounds. The air cylinder was sized to give a leverage ratio that would make the sustained swing of the lever arm easy for an adult operator. If children were frequent users of the pumping system, a separate air pump with a shorter lever arm and a smaller air cylinder could tie into plastic conduit (46) in FIG. 1 to accommodate the smaller work effort.

"Blow chamber" pipe (23) is fitted at the bottom with a check valve and strainer assembly (27). The flap valve (31) could also take the form of a ball or a disc.

Pipe (23) is fitted at the top with plastic plug cap (25), which is penetrated by dip tube (26) and air port (30). Air port (30) connects to plastic conduit (18) which in turn connects to port (21) of quick exhaust valve (20).

Dip tube (26) connects at its upper end to check valve (28). Flap valve (32) could also take the form of a ball or disc.

Plastic water conduit (29) connects to check valve (28) with a hose barb and clamp (not shown). A plastic strap (also not shown) ties the quick exhaust valve (20) to the outer wall of conduit (29) for support purposes. Air conduit (15) connects to port (16) of quick exhaust valve (20).

Drawing FIG. 2 shows the "blow chamber" in a flood condition. Flap valve (31) is shown lifted and admitting water from the elevated water table into "blow chamber" pipe (23). Flap valve (32) is being held closed by the water standing in plastic conduit (29).

Drawing FIG. 3A shows the two air valves used in the system. Both valves are off-the-shelf pneumatic valves available from a number of manufacturers, but having slight proprietary differences.

The ground-level bracket-mounted "master control valve" (10) is in total control of the pumping process. The three additional valves in the system act in a slave fashion, responding to the change of air flow through this 3-way valve.

FIG. 3A shows valve (10) being held in a closed position due to the 'UP' position of lever arm (2), which pivots on bracket-fastened pivot pin (3). See FIG. 1 boxed designator (501).

Cam follower arm (6) pivots on pin (7) and responds to 'UP' or 'DOWN' positioning of lever arm (2) by means of moving roller wheel (4) connected by pivot pin (5) to the right of cam follower arm (6). Cam arm (6) makes a sliding contact with the lower end of valve piston assembly (8) which, with an upward position, forces piston head (9) into a drilled portion of air inlet port (1) causing all air flow into the system to stop. Piston 'O'-ring (13) ensures a tight seal.

Air flow through valve (10) is reversed with piston (8) moved to the 'UP' position. All compressed air within the valve body and connecting conduit (15) would now be routed to atmosphere through the open port (11). Spring (33) acts to push valve piston assembly (8) to a full downward position when lever arm (2) drops. This results in drop of the piston head (g) to its lower position and 'O'-ring (13) will now effectively seal off atmospheric port (11).

With the compressed air supply through plastic conduit (12) blocked by a close of port (1) on valve (10), air from conduit (15) is bled to the atmosphere through open port (11). The slave-acting down-hole quick exhaust valve (20) has a rubber poppet (17) that will respond immediately to a reverse of air flow in conduit (15) and poppet (17) drops to its lower position, as illustrated in FIG. 3A.

The drop of poppet (17) will connect plastic conduit (18) to the exhaust port (19) of quick exhaust valve (20), establishing an unrestricted path for exhaust air flow from the "blow chamber" through port (21), valve body (20), and port (19).

Air released from plastic conduit (15), which is a long conduit in this installation, as indicated by break (22), has done no useful work. To keep this energy loss, which occurs at the end of each blow cycle, to a minimum, the inside diameter should be no larger than needed to accommodate the expected power inputs to the system.

Drawing FIG. 3B is a duplicate of Drawing FIG. 3A, showing air flows through the system during a blow cycle. Piston assembly (8) of valve (10) moves downward with the drop of lever arm (2), and is held solidly in this 'DOWN' position by spring (33).

The poppet (17) of valve (20) responds to air flow through port (16) and quickly moves to the 'UF' position, effectively blocking exhaust port (19) and allowing unrestricted air flow into the "blow chamber" via conduit (18).

Hopefully, it is obvious to any reader still following the presentation that, in reality, the pneumatic displacement pump presented so far is actually very simplistic in basic construction. The imagined presented system is now fully operational in a manual non-automatic mode. Lever arm (2) controlling a simple off-the-shelf valve that is designed to have a life cycle of at least 50 million cycles controls a slave-acting quick exhaust valve meeting the same design standards to direct air flow to and from the system. Two additional slave-acting water check valves, which can also be off-the-shelf, add up to a total of four moving parts in the actual water pumping process.

The unique physics of pneumatic displacement would allow the ½-gallon down-well "blow chamber" to be increased in size by a factor of over 100, were it not for the size limitations of the 2-inch well pipe. The energy input of 1/10 horsepower or less could still displace all water from the chamber and the size increase would result in an overall increase in system efficiency by reducing cycle frequency. As previously pointed out, the real gains in efficiency occur with a reduction in static head.

The about-to-be presented "siphon control chamber" assembly that allows this simplistic pump to operate fully automatically is the heart of this invention. It acts to measure the volume of water displaced from the "blow chamber" and, with a mechanical tie-in to a positive siphon flow, opens or closes the "master control valve" (10). This positive control of the "master control valve" allows energy inputs to the system to be small or large and is not affected by energy inputs that, by their nature, are start and stop inputs.

To attain the required automatic measurement capability, the system must first be primed. To accomplish this prime, the air pump handle (34) in FIG. 1 is swung back and forth, causing a flow of compressed air to air tank (500), up conduit (12), through the "master control valve" (10), down conduit (15), to quick exhaust valve (20), where it is routed into the "blow chamber" via conduit (18).

The bracket-mounted pressure gauge (55) allows a tracking of the water displaced upward in conduit (29). The first swings of the air pump handle will be accomplished with very little work effort and the gauge pressure will show a relatively large rise, due to the lack of static head and the relatively large displacement of the air pump piston at these low pressures.

The 100-foot length of water discharge conduit on the presented system has an i.d. of ½-inch and will hold close to one gallon of water. When the gauge pressure nears 22 pounds, the pressure rise will stop and air will be heard moving through water conduit (29), indicating that the down-hole "blow chamber" is now empty allowing air instead of water to move up the uncovered lower end of the dip tube.

A simple lift of the lever arm on bracket assembly box indicator (501) will close the "master control valve" and re-flood the empty "blow chamber". Drawing FIG. 3A shows air flow at this time. The lever is held up approximately three seconds on this installation to attain a complete refill of the submerged "blow chamber".

Figure 4:
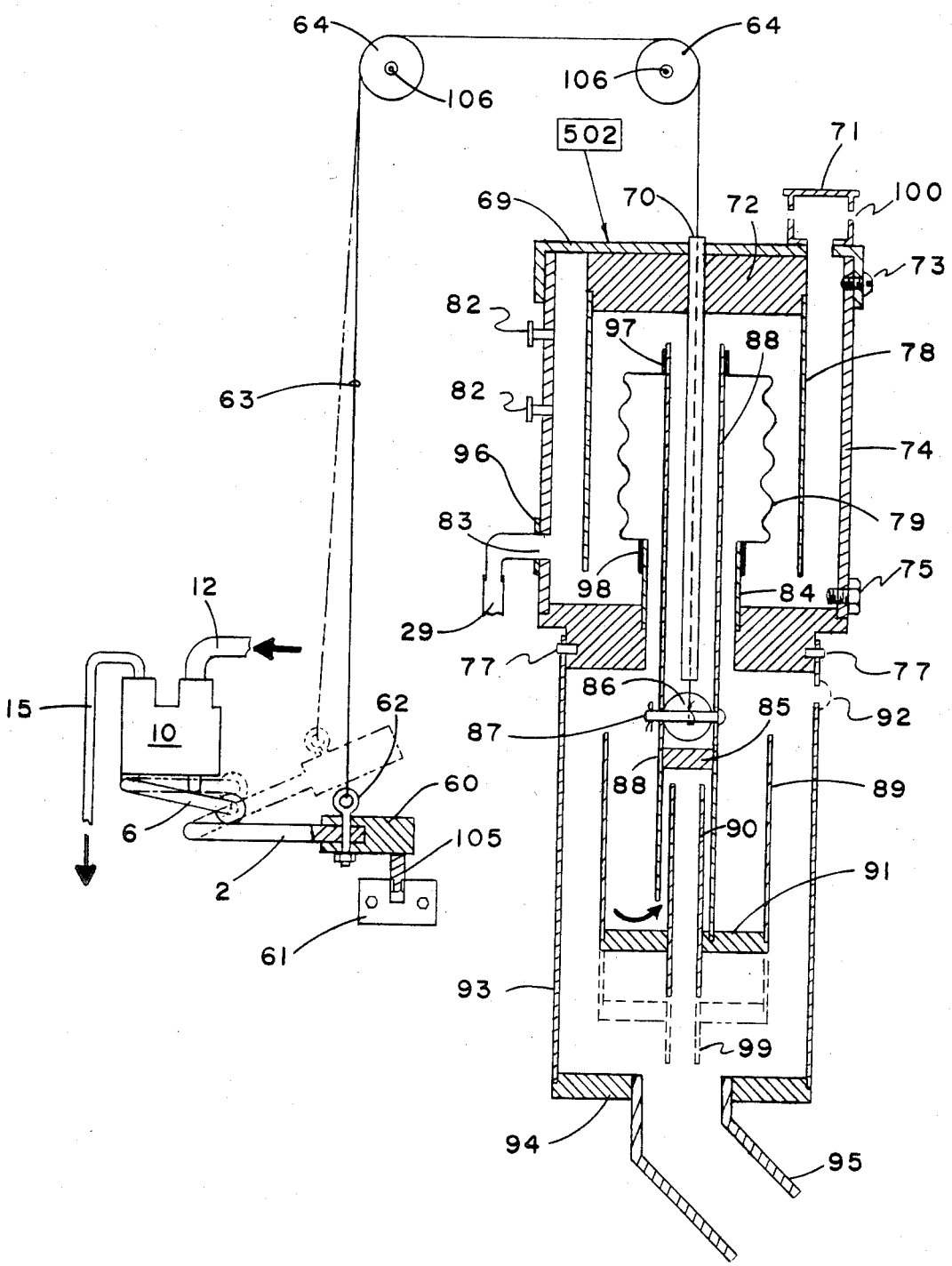
FIG. 4 is a detailed and size-distorted cutaway of the "siphon control chamber" illustrating the mechanics of pneumatic valve opening and closing to cycle the pump.

The priming process is continued until the first discharge of water into bucket (104). From this point on, the pump cycle is automatic and we can now move to Drawing FIG. 4 to examine the siphon control mechanism in detail. By using FIG. 4 to follow water flow from the "blow chamber" into the "siphon control chamber", it will be seen that the connection of plastic conduit (29) is made at flanged ell connector (96).

Water flows through port (83), which penetrates the outer wall of the chamber pipe (74) and up the annular space between pipe (74) and outer siphon pipe (78). Vent stack (71) provided with vent ports (100) allows free passage of air out of this annular space.

Water is also free to flow up the annular space between outer siphon pipe (78) and rubber bellows (79). Air displaced by this incoming water moves down the inner siphon tube (88) and exits to atmosphere through open port (86) and screened vent port (92) on the right top side of pipe (93). Pipe (93) serves to shelter bucket assembly (89) from the elements and funnel delivered water to the receiving container.

Stand pipe (84) mounts in a plastic plug (not numbered) which serves as a water-tight separation wall between the upper and lower assemblies enclosed by pipe (74) and pipe (93). Pipe (74) makes a solid and permanent connection to this unnumbered plastic plug. Pipe (93) makes a connection to the plug with metal pins (77) which, in combination with an L-shaped slot cut in the top section of pipe (93), allow a twist-lock removal of pipe (93) with its attached lower plug (94) and angled water discharge pipe (95).

Rubber bellows (79) has a lower cuff (98) which is forced over conduit (84) and forms a rubber-band type water seal at this lower connection point. The molded bellows assembly (79) is also provided with a smaller cuff (97) at its upper end, which is a force-fit over inner siphon pipe (88).

Fishing line guide pipe (70) makes an air-tight solid connection to plug (72) which acts as the common connection point for chamber cap (69) and outer siphon pipe (78).

The rubber bellows assembly (79) and fishing line guide pipe (70) effectively ensure that the only air and water exit points for water moving up the annular space between outer siphon pipe (78) and bellows assembly (79) is over the top of and through inner siphon pipe (88) and out hole (86).

Fishing line (63) is tied with a small loop at pin (87). Pin (87) is pushed through this tied loop, effectively connecting inner siphon guide pipe (88) to lever arm (2) controlling the "master control valve" (10). The fishing line is routed from the pin (87) up through the guide pipe (70) over grooved pulleys (64) which are rotated on pivot pins (106) and form part of T-bar assembly (65), shown on Drawing FIG. 1.

Fishing line (63) is routed downward from the left pulley (64) and ties to an eye bolt (62) which, in addition to making the connection to lever arm (2), retains an iron counter-weight (60). Iron counter-weight (60) in the lever arm 'DOWN' position makes contact with magnet (105). Magnet (105) is a cylinder magnet pressed into a plastic block that mounts on a metal bracket, boxed designator (501) in FIG. 1, common to the "master control valve" assembly.

With a progressive increase in the amount of displaced water transferred to the upper chamber encompassed by pipe (74), the water level will rise to a point where it overflows the top of inner siphon guide pipe (88).

Water flowing down the inside of pipe (88) will encounter solid plastic plug (85) and be directed out large hole (86) where it falls into siphon bucket (89). Pipe (88) below plastic plug (85) becomes the outer siphon pipe for siphon bucket (8g). The inner siphon pipe for this plastic bucket is formed by standing pipe (90) mounted in plug cap (91), which also retains siphon bucket pipe (89). Water flows up the annular space between inner pipe (90) and outer pipe (88) through a hole drilled in the lower left edge of pipe (88). An arrow indicates this flow path.

Plug (75) located on lower right side of upper chamber pipe (74) allows any sand or sediment to be drained from the chamber. Plastic pins (82) on the top left of chamber pipe (74) fit the notched mounting bracket (68) in Drawing FIG. 1.

Screw (73) allows the upper assembly of the "siphon control chamber" to be removed in one piece after disconnecting the fishing line (63) from eye bolt (62). This one-piece upper assembly will include: cap (69), vent stack (71), plastic plug cap (72), outer siphon pipe (78), and fishing line guide pipe (70).

Twisting lower pipe (93) counter-clockwise to line up pins (77) with the short leg of the L-shaped slot will allow pipe (93) to drop as an assembly with plug cap (94) and water guide pipe (95).

Forcing the top edge of the upper inner siphon pipe (88) through the tight-fitting cuff (97) of bellows assembly (79) will allo removal of the siphon bucket assembly consisting of: inner and outer siphon pipe (88), plastic plug (85), plug cap (91), inner siphon pipe (90), and outer siphon bucket pipe (89).

With the overflow of upper siphon pipe (88) causing water to exit hole (86), the water deposited in the bottom of bucket (89) will soon overcome the weight of iron counter-weight (60) on lever arm (2) of the "master control valve" assembly. However, the magnetic pull of magnet (105) also fights to hold bucket (89) in the 'UP' position. The force of this magnetic pull is such that bucket (89) will be at least half-full before the magnetic attraction is broken. This detent action ensures that bucket (89) will fall rapidly for a positive close of "master control valve" (10).

With the drop of bucket (89) to the position shown by the dotted line designator (99), upper siphon pipe (88) will fall well below the surface of the water standing in siphon chamber pipe (74). A positive flood siphon is initiated by this drop of pipe (88) and water spilling through the hole (86) will quickly flood and overflow the outer edge of (89) to be directed through exit pipe (95).

The flood of bucket (89) creates a second siphon in the annular space between pipe (90) and pipe (88). An empty chamber will cause the siphon above plug (85) in tube (88) to break. The siphon initiated in the lower siphon bucket will quickly drain the bucket and iron counter-weight will return bucket (89) to 'UP' position shown.

The flow of the siphon can be regulated at hole (86) with one or more tight-fitting rubber band(s) that can be slid down pipe (88) to block opening hole (86) and, thus, increase bucket down time. The rubber bands are not shown.

Figure 5:
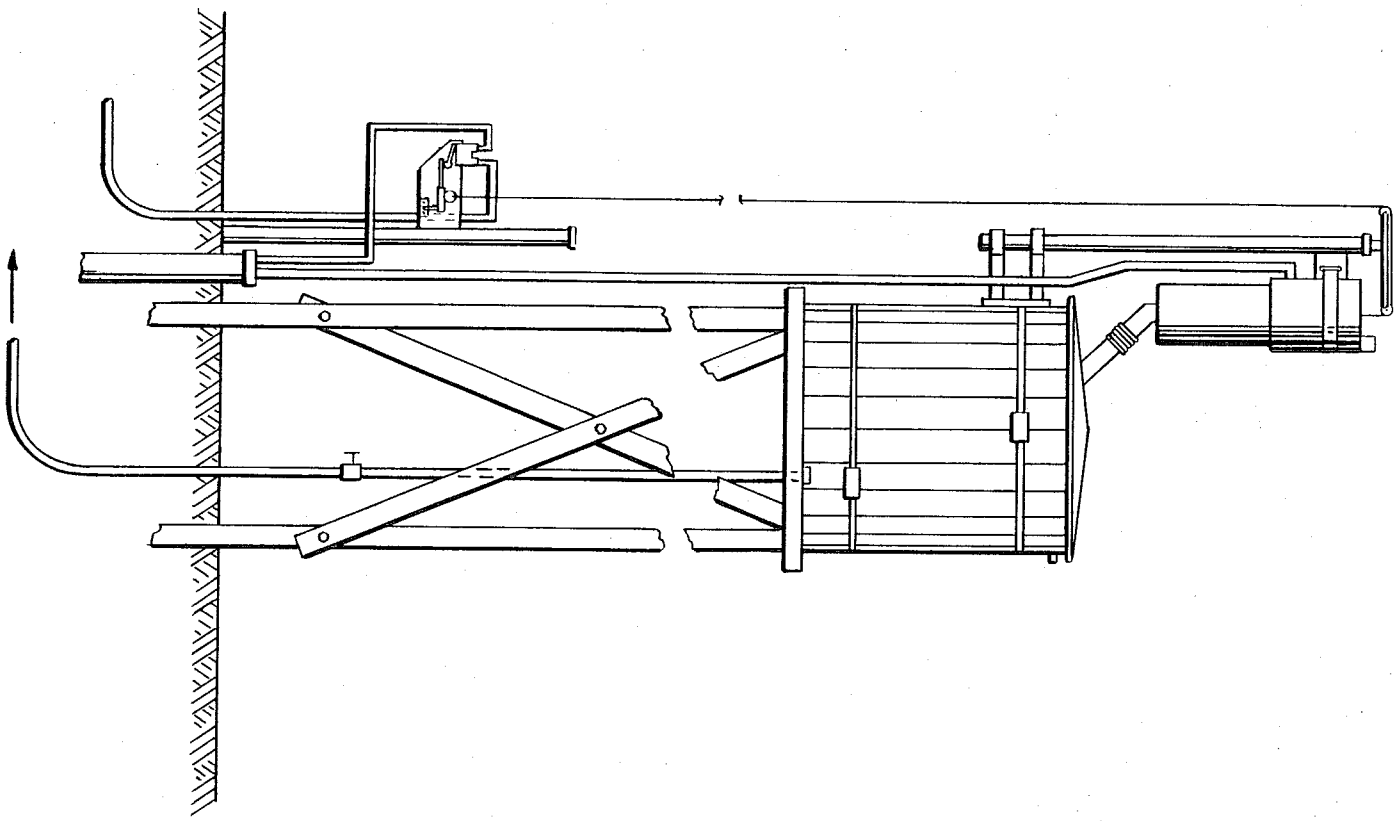
FIG. 5 is an alternative embodiment of the pneumatic pumping system of FIG. 1.

The Drawing FIG. 5 shows the ease with which the presented pump can be adapted to deliver water to an elevated tank and provide a gravity-type water supply for the user.

Flange (111) connects to the bottom of tank (109) with attached conduit (112). Shut-off valve (113) feeds water to the user via an underground plastic conduit.

The "master control valve" assembly (501) is left at ground level, but the siphon control chamber is elevated to the top of a tank and remounted on a new pole (107) bolted to tank (109) with bracket (106). Stub pipe (110) is the vent and overflow at the tank top. Pipe (108), through a flex hose, delivers water to the top of the tank.

The air pump on this tank-mounted system could be far distant from the tank location. Compressed air would be transported to the system via underground plastic conduit (114).

Figure 6:
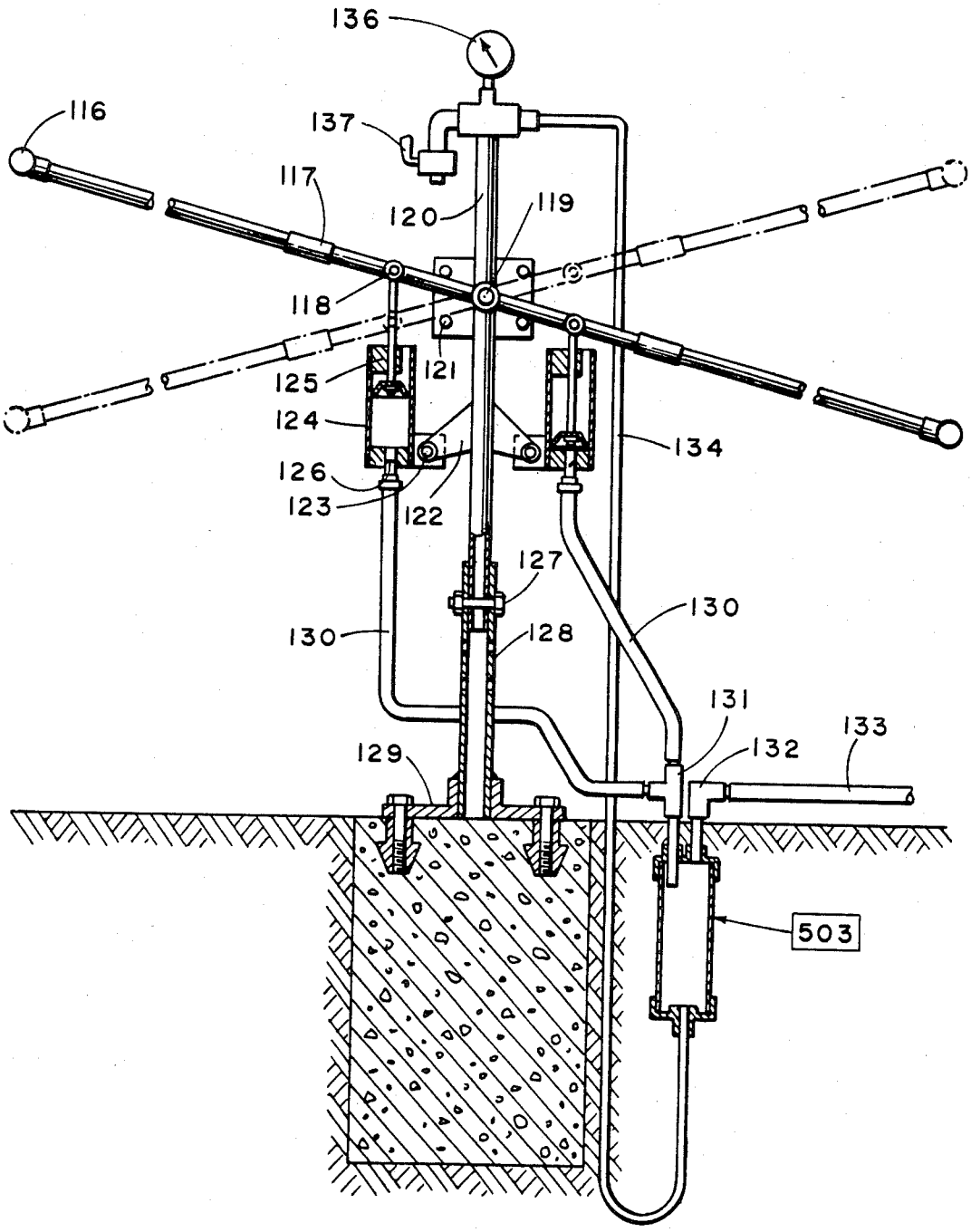
FIG. 6 is an alternative embodiment of the human-powered air pump illustrated in FIG. 1.

Drawing FIG. 6 shows an air pump design allowing the energies of two people to be combined for pumping in the same fashion that some early firefighters operated a very similar two-man water pump. The two-operator air pump design incorporates the same change of leverage features as the single operator pump previously described. Bracket pins (121) limit and fix the stroke of the changeable cylinder assemblies (124). The drilled plastic guide bushing (125) serves to retain the pump piston within the center of the cylinder. The different diameter cylinders are provided with matching pivot brackets (122) which, with bolts (not shown), are fastened to pipe (120).

Disc or ball check valves (126) are provided at the discharge point of the air cylinders as replaceable units in a caged assembly. This feature is not shown but is conventional in small liquid pumps (i.e., the automobile fuel pump).

Pivot points (118) and (123) are plastic spool bearings as previously described. Operating arm pivot (119), being a point of high stress, uses a conventional metal sleeve bearing that is lubricated with grease.

Pipe (128) mounted to concrete with flange (129) is drilled to accommodate the lowering of shaft (120). This lowering is accomplished by removing bolt (127).

Hold points (116) on the pump operating handles rotate to allow a comfortable hand hold while pumping.

Coupling (117) allows an easy change of the lever arm length, as explained previously on the single cylinder pump.

Compressed air from pump cylinder (124) moves through conduits (130) to tee (131) into air receiver tank assembly (503). Out of the bottom of receiver tank assembly (503), conduit (134) carries air to a pole-mounted tee, which mounts a pressure gauge (136) and a valve (137) to remove condensate. Air from the receiver tank assembly (503) moves to the pumping system through ell (132) and conduit (133).

The pump illustrated in FIG. 6 would allow the energies of a large number of people to be combined in low head water lifts common to irrigation. In lesser-developed countries, irrigation frequently involves a bucket carrying process wherein water is physically carried from a water source to a distant garden spot. The use of a large "blow chamber", with a matching "siphon control chamber", in combination with an elevated tank as shown in FIG. 5, would be a very feasible replacement for this labor-intensive bucket carry.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A method for pumping fluid, including the steps of:
   - displacing fluid in a blow chamber by forcing compressed air into said blow chamber;
   - collecting fluid forced from said blow chamber in a first chamber;
   - siphoning said fluid from said first chamber when the collected fluid reaches a predetermined volume;
   - collecting said fluid siphoned from said first chamber in a bucket means;
   - terminating the application of compressed air to said blow chamber when a predetermined quantity of fluid has been collected in said bucket means;
   - opening a venting means whereby said blow chamber is vented to ambient atmosphere when said predetermined quantity of fluid has been collected;
   - filling said blow chamber with fluid from a surrounding source;
   - initiating a timing interval by siphoning said collected fluid; and terminating said timing interval when a predetermined quantity of said collected fluid has been siphoned.

2. A method for pumping fluid as defined in claim 1, including the additional steps of: closing said venting means; and forcing compressed air into said blow chamber when said timing interval is terminated to initiate another pumping cycle.

3. A method for pumping fluid as defined in claim 2 wherein the step of collecting a predetermined quantity of said fluid forced from said blow chamber comprises the additional steps of:

collecting said fluid in a first chamber.

4. A method for pumping fluid as defined in claim 3, including the additional steps of:

siphoning said fluid from said bucket means when said collected fluid reaches a predetermined volume.

5. A method for pumping fluid as defined in claim 4, wherein said step of terminating the application of compressed air to said blow chamber includes the additional steps of mutually exclusively closing a valve between said compressed air source and said blow chamber and opening a venting port between said blow chamber and the atmosphere when the weight of said quantity of fluid collected in said bucket overcomes the combined resistance of a counterweight and magnetic restraint.

6. A method for pumping fluid as defined in claim 5, including the additional steps of:

siphoning fluid from said bucket; and raising said bucket by the force of said counterweight when the volume of said fluid in said bucket has been reduced to a predetermined volume.

7. A method for pumping fluid as defined in claim 6, comprising the further step of restraining said counterweight to hold said bucket in a raised position by a magnetic means.

8. A method for pumping fluid as defined in claim 7, including the additional steps of:

restoring the application of compressed air to said blow chamber when said counterweight raises said bucket; and closing an additional venting means for said blow chamber by the force of compressed air applied to said blow chamber.

9. A method for pumping fluid as defined as claim 8 wherein said fluid is water, said step of filling said blow chamber includes the step of admitting water to said blow chamber through a one-way valve, and said surrounding source comprises a well.

10. A method for pumping fluid as defined as claim 9, including the additional step of manually operating a low volume piston pump to generate said compressed air forced into said blow chamber.

11. An apparatus for pumping fluid, comprising:

a blow chamber positioned in a fluid reservoir and at least partially below the fluid level there of;

means for permitting one-way fluid flow from said reservoir into said blow chamber;

a source of compressed air;

a master control valve, including a first position for porting said compressed air into said blow chamber;

a control chamber, including first and second fluid collecting means;

said control chamber positioned above said blow chamber;

a fluid conduit connected between said blow chamber and said control chamber;

means for siphoning fluid from said first fluid collecting means into said second fluid collecting means when said control chamber has received a predetermined volume of fluid;

means for moving said master control valve out of said first position to terminate said supply of compressed air to said blow chamber when said control chamber has received a predetermined volume of fluid; and means for venting said blow chamber to ambient atmosphere when said supply of compressed air is terminated.

12. An apparatus as defined in claim 11, wherein said means for moving said master control valve includes means to return said master control valve to said first position when a predetermined quantity of fluid has been siphoned from said fluid collecting means.

13. An apparatus for pumping fluid as defined in claim 12, wherein said fluid is water and said reservoir is a well.

14. An apparatus as defined in claim 12, wherein said means for venting said blow chamber to ambient atmosphere is a valve port which is closed when said master control valve is in said first position and open when said master control valve is moved out of said first position.

15. An apparatus for pumping fluid as defined in claim 12 wherein said means for venting said blow chamber to ambient atmosphere comprises a poppet valve including a venting port and a through port which open in a mutually exclusive fashion and said through port is opened by compressed air flowing from said master control valve to said blow chamber.

16. An apparatus for pumping fluid as defined in claim 15 further comprising:

a fluid measuring means for receiving fluid siphoned from said fluid collecting means;

a lever arm for moving said master control valve between said first position and a second position; and means for mechanically coupling said lever arm to said fluid measuring means so that said fluid measuring means will be raised by said lever arm when drained of fluid to a predetermined quantity and said lever arm will be raised by said fluid measuring means when filled with a predetermined quantity of fluid.

17. An apparatus as defined in claim 16, wherein said fluid measuring means includes a siphon for draining said second fluid collecting means when said second fluid collecting means has been filled to a predetermined level.

18. An apparatus for pumping fluid as defined in claim 17, further comprising:

a siphon tube mechanically secured to said fluid measuring means and including opening means whereby water entering said siphon tube from said fluid collecting means is diverted into said fluid measuring means;

a flexible, waterproof bellows positioned in said fluid collecting means;

means to secure said siphon tube to said bellows whereby said bellows supports said siphon tube and said mechanically attached bucket in a manner which causes said bellows to be compressed as said fluid measuring means is filled with fluid siphoned through said siphon tube from said fluid collecting means; and said siphon tube and said bellows positioned relative to said fluid collecting means so the upper opening of said siphon tube is lowered within said fluid collecting means as said bellows collapses to increase the amount of fluid siphoned from said fluid collecting means.

19. An apparatus as defined in claim 18, further comprising:

an elevated water storage tank;

means to position said control chamber above said elevated water storage tank; and means for channeling water siphoned from said fluid measuring means into said elevated water storage tank.

20. An apparatus as defined in claim 19 wherein said master control valve is positioned below said elevated water storage tank at an elevation above ground which permits the operation thereof by a person standing on the ground.

21. An apparatus as defined in claim 20, including a locking pin means for securing said lever arm in a raised position to hold said master control valve in said second position to maintain said apparatus in an off condition.

22. An apparatus as defined in claim 21, further comprising a storage tank for providing said source of compressed air.

23. An apparatus as defined in claim 22, including:

a manually operable air pump;

an air line connecting said manually operable air pump to said storage tank; and said air line including a one-way valve adapted to permit the flow of air from said pump to said storage tank.

24. An apparatus as defined in claim 23, wherein said manually operable air pump includes:

first and second pumps operating 180 degrees out of phase to alternately supply air to said storage tank;

said pumps each including a piston and piston rod;

an air pump operating handle supported by a pivot means at its mid-point and arranged in a normally horizontal position whereby an operator may be positioned at either end to raise and lower the respective handle ends; and means connecting said piston rod of one pump to said operating handle on one side of said pivot and means for connecting said piston rod of the other pump to said operating handle at the other side of said pivot.

* * * * *